US010180661B2

(12) United States Patent
Sakumoto

(10) Patent No.: US 10,180,661 B2
(45) Date of Patent: Jan. 15, 2019

(54) FREQUENCY DIVISION CIRCUIT, METHOD OF CONTROLLING FREQUENCY DIVISION CIRCUIT, AND ANALOG ELECTRONIC TIMEPIECE

(71) Applicant: SEIKO INSTRUMENTS INC., Chiba-shi, Chiba (JP)

(72) Inventor: Kazumi Sakumoto, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 125 days.

(21) Appl. No.: 15/072,749

(22) Filed: Mar. 17, 2016

(65) Prior Publication Data

US 2016/0342139 A1 Nov. 24, 2016

(30) Foreign Application Priority Data

May 18, 2015 (JP) ..... 2015-101396

(51) Int. Cl.
*G04G 3/02* (2006.01)

(52) U.S. Cl.
CPC ..... *G04G 3/02* (2013.01)

(58) Field of Classification Search
CPC . G04C 3/14; G04G 3/02; G04G 3/022; G04G 3/025; G04G 3/027
See application file for complete search history.

(56) References Cited

U.S. PATENT DOCUMENTS 4,293,939 A * 10/1981 Nishikubo ..... G04G 13/025 368/251
4,484,123 A * 11/1984 Raducanu ..... G04C 3/14 318/685
9,116,508 B2 * 8/2015 Kyou ..... G04C 3/143
2002/0103618 A1 * 8/2002 Schleifer ..... G01R 13/345 702/176
2008/0012651 A1 * 1/2008 Nakamura ..... H03L 7/099 331/18
2009/0003424 A1 * 1/2009 Waayers ..... G01R 31/31858 375/226
2014/0219068 A1 * 8/2014 Kyou ..... G04C 3/143 368/186

OTHER PUBLICATIONS

English translation—JP2007114031—espacenet.com—Aug. 31, 2017.*
Drawings—JP2007114031—espacenet.com—Aug. 31, 2017.*
Abstract, Publication No. JP 2007-114031, Publication date May 10, 2007.

* cited by examiner

*Primary Examiner* — Sean Kayes
(74) *Attorney, Agent, or Firm* — Adams & Wilks

(57) ABSTRACT

A frequency division circuit includes a first frequency division circuit which divides a frequency of a reference signal that is generated by an oscillation circuit. An input/output terminal outputs an output signal of the first frequency division circuit for testing. A selection circuit outputs as an intermediate signal one of a first intermediate signal which is input from the input/output output terminal, and a second intermediate signal which is an output signal of the first frequency division circuit. A second frequency division circuit divides a frequency of the intermediate signal output from the selection circuit. A switching time count circuit begins counting a predetermined amount of time after the second frequency division circuit starts frequency-dividing the intermediate signal and, after elapse of the predetermined amount of time, switches the intermediate signal output from the selection circuit from the first intermediate signal to the second intermediate signal.

6 Claims, 8 Drawing Sheets

11: OSCILLATION CIRCUIT
21: UPPER STAGE FREQUENCY DIVISION CIRCUIT
24: SELECTION CIRCUIT
25: LOWER STAGE FREQUENCY DIVISION CIRCUIT
26: SWITCHING TIME COUNT CIRCUIT
13: CONTROL CIRCUIT
14: STEPPING MOTOR DRIVE CIRCUIT

ST1: SET OUTPUT OF SELECTION CIRCUIT TO INTERMEDIATE SIGNAL 1
ST2: PERFORM SWITCHING TIME COUNT PROCESSING
ST3: DOES COUNTING REACH SWITCHING TIME ?
ST4: SET OUTPUT OF SELECTION CIRCUIT TO INTERMEDIATE SIGNAL 2
ST5: CONTINUE SYSTEM OPERATION BY INTERMEDIATE SIGNAL 2

FREQUENCY DIVISION CIRCUIT, METHOD OF CONTROLLING FREQUENCY DIVISION CIRCUIT, AND ANALOG ELECTRONIC TIMEPIECE

BACKGROUND OF THE INVENTION

Field of the Invention

The present invention relates to a frequency division circuit, a method of controlling the frequency division circuit, and an analog electronic timepiece.

Background Art

A frequency division circuit that is used for an analog electronic timepiece includes a monitor terminal from which an output signal of an upper stage frequency division circuit is output to the outside, in an intermediate portion of a frequency division stage, in order to measure the accuracy of a crystal vibrator. In addition, in order to perform a test (acceleration test) of a lower stage frequency division circuit, a signal from the outside is input to the lower stage frequency division circuit through the monitor terminal (refer to FIG. 8).

However, since a signal is input to and output from the same monitor terminal, if noise such as static electricity is input to the monitor terminal from the outside, an operation of the lower stage frequency division circuit is disturbed, and a phenomenon occurs in which time varies or an operation is not performed.

In order to solve the problem, a method in which an input and output function of the monitor terminal is switched by using a signal from another input terminal as a control signal has been disclosed (refer to JP-A-2007-114031).

However, in this method, a control terminal SELECT has to be provided as a new input terminal (refer to FIG. 9). An input terminal of an IC requires not only a pad portion, but also a diode for input protection or a resistor for limiting a current, and an area which is occupied by one terminal affects the entire area of the IC.

In addition, there is a problem in which, although the monitor terminal is used as an output terminal by a newly provided control terminal, if noise such as static electricity is input to the control terminal, the monitor terminal functions as an input terminal, and an operation of the frequency division circuit is disturbed by noise such as static electricity.

SUMMARY OF THE INVENTION

In order to solve the above-described problem, the present invention provides a frequency division circuit which can prevent an abnormal operation.

According to the present invention, a frequency division circuit includes a first frequency division circuit which divides a frequency of a reference signal that is generated by an oscillation circuit; an input and output terminal from which an output signal of the first frequency division circuit is output to the outside; a selection circuit which outputs one of a first intermediate signal that is one of a signal which is output to the input and output terminal and a signal which is input from the input and output terminal, and a second intermediate signal that is an output signal of the first frequency division circuit, as an intermediate signal; a second frequency division circuit which divides a frequency of the intermediate signal; and a switching time count circuit which counts a predetermined amount of time after startup of the frequency division circuit, and switches the intermediate signal that is output from the selection circuit from the first intermediate signal to the second intermediate signal, after the predetermined amount of time passes.

In addition, in the frequency division circuit according to the present invention, the second frequency division circuit includes a frequency divider group in which multiple frequency dividers are connected in series, each dividing a frequency of an input signal in half to output as an output signal, and the switching time count circuit counts the predetermined amount of time, based on an output signal of one of the frequency dividers of the frequency divider group.

In addition, in the frequency division circuit according to the present invention, a frequency of a signal, which is the first intermediate signal and is input from the input and output terminal, is higher than a frequency of the second intermediate signal.

According to the present invention, a method of controlling a frequency division circuit including a first frequency division circuit which divides a frequency of a reference signal that is generated by an oscillation circuit; an input and output terminal from which an output signal of the first frequency division circuit is output to the outside; a selection circuit which outputs one of a first intermediate signal that is one of a signal which is output to the input and output terminal and a signal which is input from the input and output terminal, and a second intermediate signal that is an output signal of the first frequency division circuit, as an intermediate signal; a second frequency division circuit which divides a frequency of the intermediate signal; and a switching time count circuit, includes causing the switching time count circuit to count a predetermined amount of time after startup of the frequency division circuit; and causing the switching time count circuit to switch the intermediate signal that is output from the selection circuit from the first intermediate signal to the second intermediate signal, after the predetermined amount of time passes.

According to the present invention, an analog electronic timepiece includes a stepping motor which rotates hands of a timepiece; a stepping motor drive circuit which outputs a motor drive pulse to the stepping motor; and a control circuit which causes the motor drive pulse synchronous to a frequency division signal that is output from the frequency division circuit to be output from the stepping motor drive circuit.

According to the present invention, an output signal of a first frequency division circuit is divided into two signals. One signal is output to the outside through the monitor terminal (input and output terminal) as an output signal, and is set to a first intermediate signal which accelerates an operation of a second frequency division circuit after the intermediate signal, in response to a signal which is input to the monitor terminal from the outside. The other signal is set to a second intermediate signal, and the selection circuit that selects which one of the first intermediate signal and the second intermediate signal is input to the second frequency division circuit after the intermediate signal, is provided. The switching time count circuit counts a predetermined amount of time after startup of the frequency division circuit, and switches the intermediate signal which is output from the selection circuit from the first intermediate signal to the second intermediate signal, after the predetermined amount of time passes. The second intermediate signal is not affected by noise such as static electricity from the monitor terminal unlike the first intermediate signal. Hence, according to the present invention, it is possible to provide a frequency division circuit which can prevent an abnormal operation.

DETAILED DESCRIPTION OF THE INVENTION

Hereinafter, an embodiment according to the present invention will be described with reference to the drawings.

First Embodiment

Figure 1:
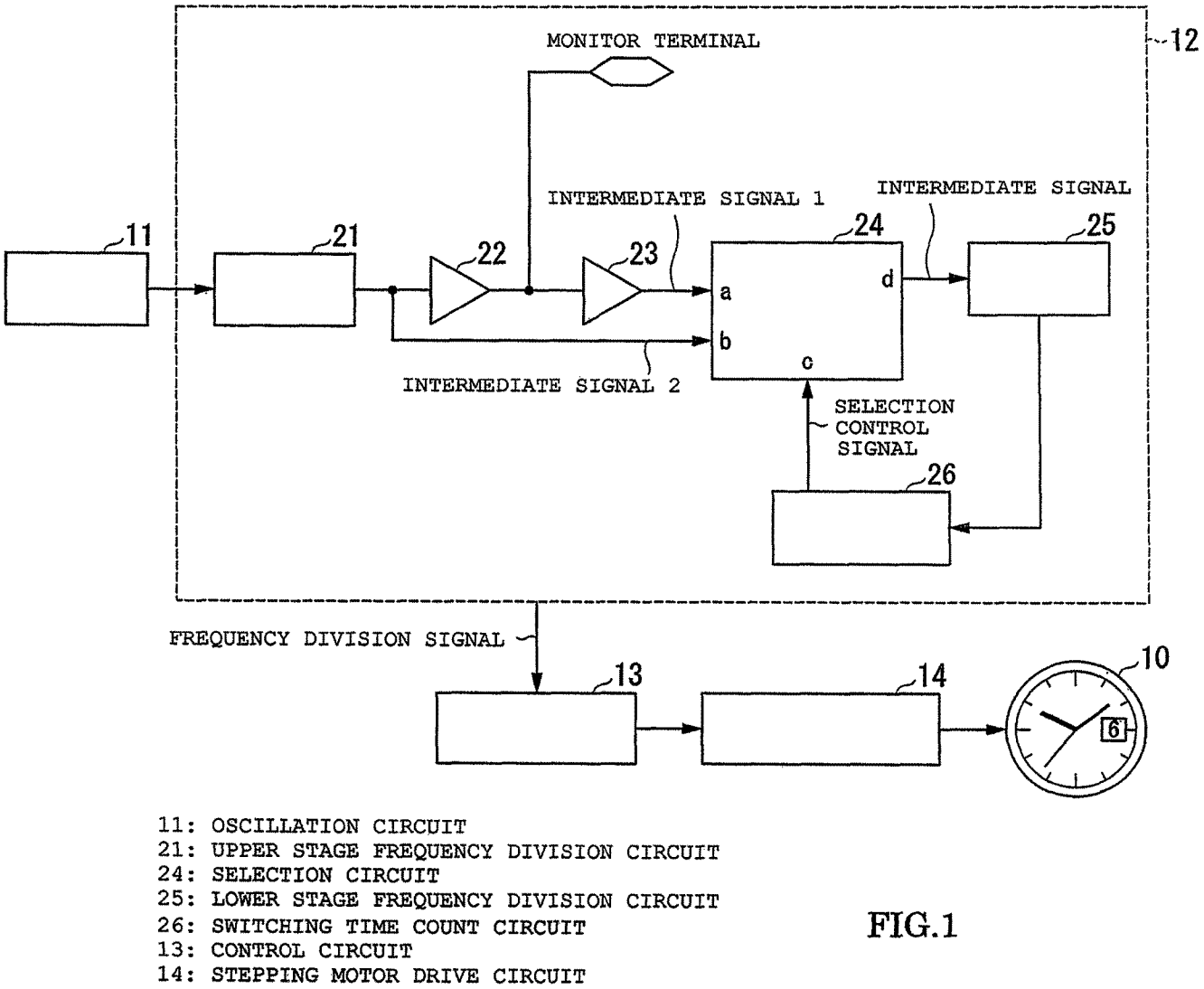
FIG. 1 is a block diagram illustrating a configuration of an analog electronic timepiece according to the present embodiment.

FIG. 1 is a block diagram illustrating a configuration of an analog electronic timepiece according to the present embodiment.

As illustrated in FIG. 1, an analog electronic timepiece 10 includes an oscillation circuit 11, a frequency division circuit 12, a control circuit 13, and a stepping motor drive circuit 14.

The oscillation circuit 11 includes a crystal vibrator, and generates a reference signal. The reference signal has a frequency of 32768 Hz in the present embodiment.

The frequency division circuit 12 divides the reference signal which is output from the oscillation circuit 11, and outputs a frequency division signal to the control circuit 13.

The control circuit 13 outputs a monitor drive pulse synchronous to the frequency division signal which is output from the frequency division circuit 12 to the stepping motor drive circuit 14.

The stepping motor drive circuit 14 outputs the motor drive pulse to a stepping motor which rotatably drives hands of the analog electronic timepiece 10.

The frequency division circuit 12 includes an upper stage frequency division circuit 21, a buffer circuit 22, a buffer circuit 23, a selection circuit 24, a lower stage frequency division circuit 25, and a switching time count circuit 26.

In the present embodiment, the upper stage frequency division circuit 21 includes a frequency divider group in which eight frequency dividers are connected in series, each dividing a frequency of an input signal in half. The upper stage frequency division circuit 21 divides a reference signal which is output from the oscillation circuit 11, and outputs an intermediate signal 2 (second intermediate signal) of 128 Hz to the selection circuit 24. The intermediate signal 2 may be referred to as Q128 in the present embodiment.

The buffer circuit 22 performs waveform shaping of Q128, and outputs Q128 to a monitor terminal (input and output or input/output terminal).

The buffer circuit 23 outputs an intermediate signal 1 (first intermediate signal) which is one of a signal output from the monitor terminal and a signal input to the monitor terminal, to the selection circuit 24.

The selection circuit 24 outputs one of a signal a (intermediate signal 1) and a signal b (intermediate signal 2) to the lower stage frequency division circuit 25 as a signal d (intermediate signal), based on a signal c (selection control signal) which is input from the switching time count circuit 26.

Here, a circuit configuration of the selection circuit 24 will be described with reference to FIGS. 2 and 3.

Figure 2:
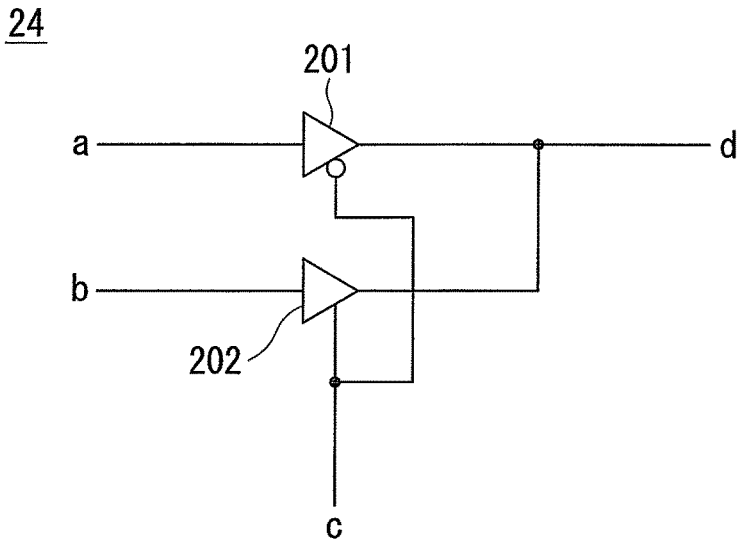
FIG. 2 is a diagram illustrating an example of a circuit diagram of a selection circuit.

FIG. 2 is a diagram illustrating an example of a circuit diagram of the selection circuit 24. The selection circuit 24 is configured by a circuit 201 and a circuit 202. The circuit 201 outputs the signal a (intermediate signal 1) as the signal d (intermediate signal), when the signal c (selection control signal) is in a low level (L). The circuit 202 outputs the signal b (intermediate signal 2) as the signal d, when the signal c is in a high level (H).

That is, the selection circuit 24 outputs one of the intermediate signal 1 and the intermediate signal 2 to the lower stage frequency division circuit 25 as an intermediate signal, based on the selection control signal which is input from the switching time count circuit 26.

Figure 3:
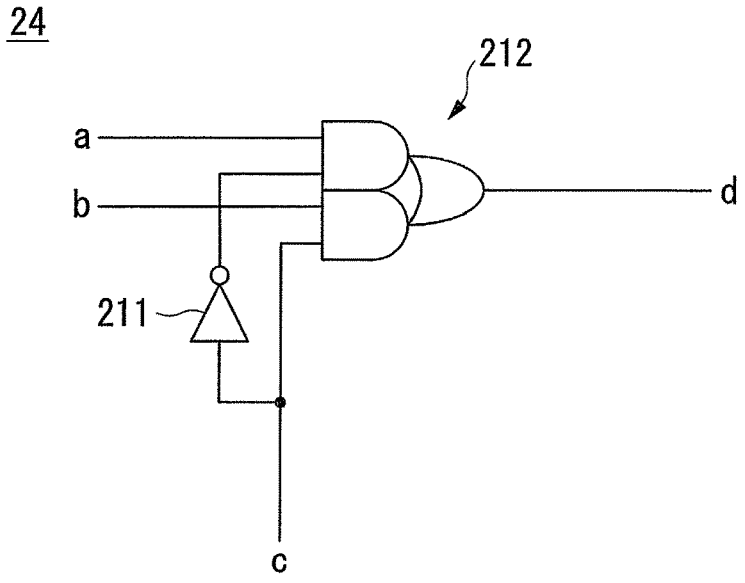
FIG. 3 is a diagram illustrating another example of the circuit diagram of the selection circuit.

FIG. 3 is a diagram illustrating another example of the circuit diagram of the selection circuit 24. The selection circuit 24 is configured by a circuit 211 and a circuit 212. The circuit 211 is an inverter circuit, and outputs a signal in an H level, when the signal c is in an L level. In addition, the circuit 211 outputs a signal in an L level, when the signal c is in an H level. The circuit 212 outputs the signal a as the signal d, when an output of the circuit 211 is in an H level. The circuit 212 outputs the signal b as the signal d, when the output of the circuit 211 is in an L level.

That is, the selection circuit 24 outputs one of the intermediate signal 1 and the intermediate signal 2 to the lower stage frequency division circuit 25 as an intermediate signal, based on the selection control signal which is input from the switching time count circuit 26.

Returning to FIG. 1, in the present embodiment, the lower stage frequency division circuit 25 includes a frequency divider group in which seven frequency dividers are connected in series, each dividing a frequency of an input signal in half.

Here, a case in which a frequency division signal is generated from the intermediate signal 1 that is one of a signal output from the monitor terminal and an external signal input to the monitor terminal will be described with reference to FIGS. 4 and 5. The signal which is output from the monitor terminal is Q128 (signal of 128 Hz) whose waveform is shaped by the buffer circuit 22. Meanwhile, the external signal input to the monitor terminal is a signal of 32768 Hz which is input to the monitor terminal from an oscillation source.

Figure 4:
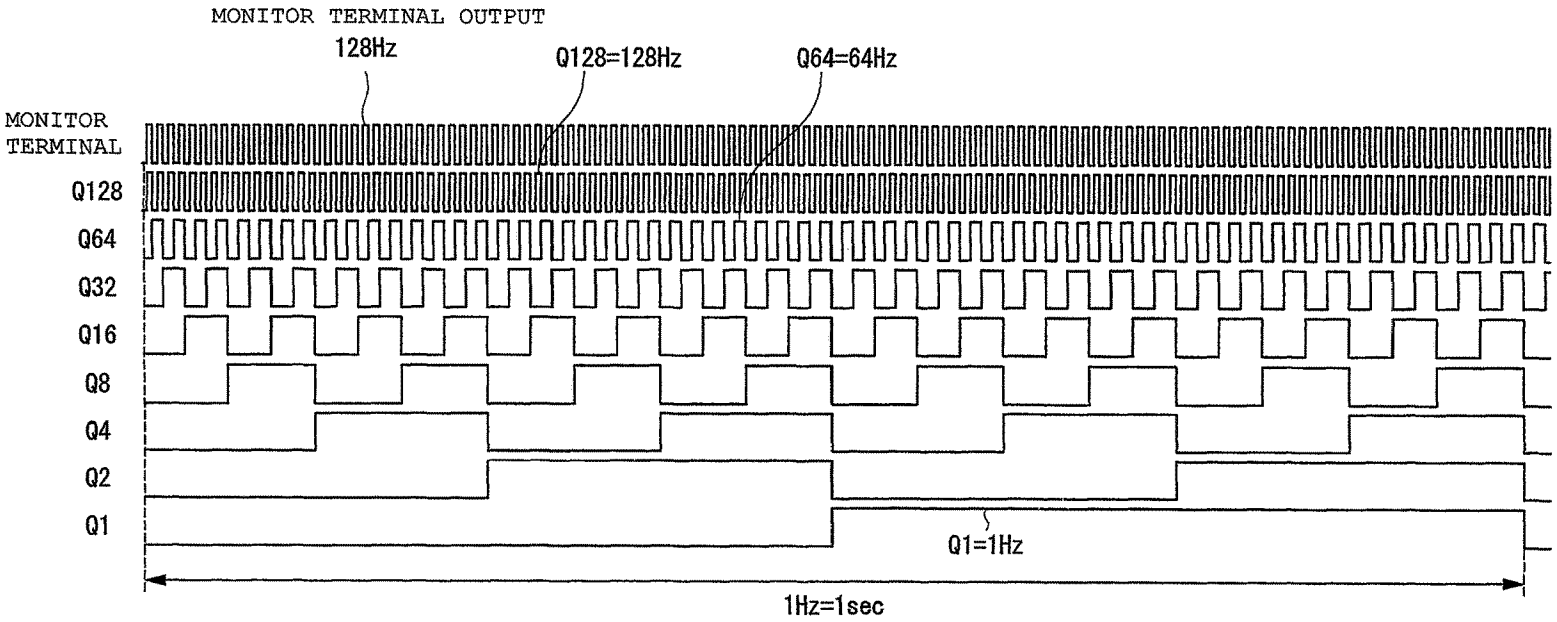
FIG. 4 is a timing chart illustrating an operation of outputting a frequency division signal by dividing a signal of 128 Hz which is input to a lower stage frequency division circuit.

FIG. 4 is a timing chart illustrating an operation of outputting a frequency division signal by dividing a signal of 128 Hz which is input to the lower stage frequency division circuit 25. In FIG. 4, Q64 is an output signal of a first stage of multiple frequency dividers, which are connected in series, of a frequency divider group in the lower stage frequency division circuit 25. Hereinafter, Q32, Q16, Q8, Q4, Q2, and Q1 are respectively output signals of a second stage, a third stage, a fourth stage, a fifth stage, a sixth stage, and a seventh stage of the frequency dividers of the frequency divider group.

The upper stage frequency division circuit 21 divides the output signal (32768 Hz) of the oscillation circuit 11, and outputs the divided output signal from the monitor terminal through the buffer circuit 22 as Q128 (signal of 128 Hz).

Q128 output from the monitor terminal is used for measuring accuracy of a crystal vibrator. In addition, Q128 output from the monitor terminal is input to the lower stage frequency division circuit 25 through the buffer circuit 23, and is divided into Q64=64 Hz, Q32=32 Hz, Q16=16 Hz, Q8=8 Hz, Q4=4 Hz, and Q2=2 Hz, and divided to Q1=1 Hz (1 sec) which is a frequency division signal. The signal may be divided to a signal lower than or equal to 1 Hz, according to apparatuses.

Here, in order to move a second hand of the timepiece in an interval of 1 sec, it is necessary that the control circuit 13 outputs a motor drive pulse to a stepping motor from the stepping motor drive circuit 14 in synchronization with the frequency division signal of 1 sec described above, thereby driving a motor of the analog electronic timepiece 10.

However, in a manufacturing process of the timepiece, it is necessary to inspect whether or not the motor drive pulse is correctly output in the interval of 1 sec as described above, and actual operation time can be inspected only after one second passes because the interval is one second. Furthermore, there is a case in which a pulse that is output only in an interval of one second or more, or an operation thereof is inspected. In a manufacturing process, reduction of inspection time affects an increase of the amount of manufacture and greatly affects costs, and thus, it is preferable that the inspection time is reduced.

Hence, if an oscillation source with very small output impedance is connected to the monitor terminal and a signal is input to the monitor terminal, an input signal of the lower stage frequency division circuit 25 becomes not Q128 which is an output of the upper stage frequency division circuit 21, but a signal of the oscillation source which is input to the monitor terminal. For example, if a signal which is input to the monitor terminal from an oscillation source is set to a signal of 32768 Hz, a signal with a high frequency of 32768 Hz is input to the lower stage frequency division circuit 25 instead of 128 Hz, and thus, it is possible to perform time acceleration of 32768/128=256 times.

Figure 5:
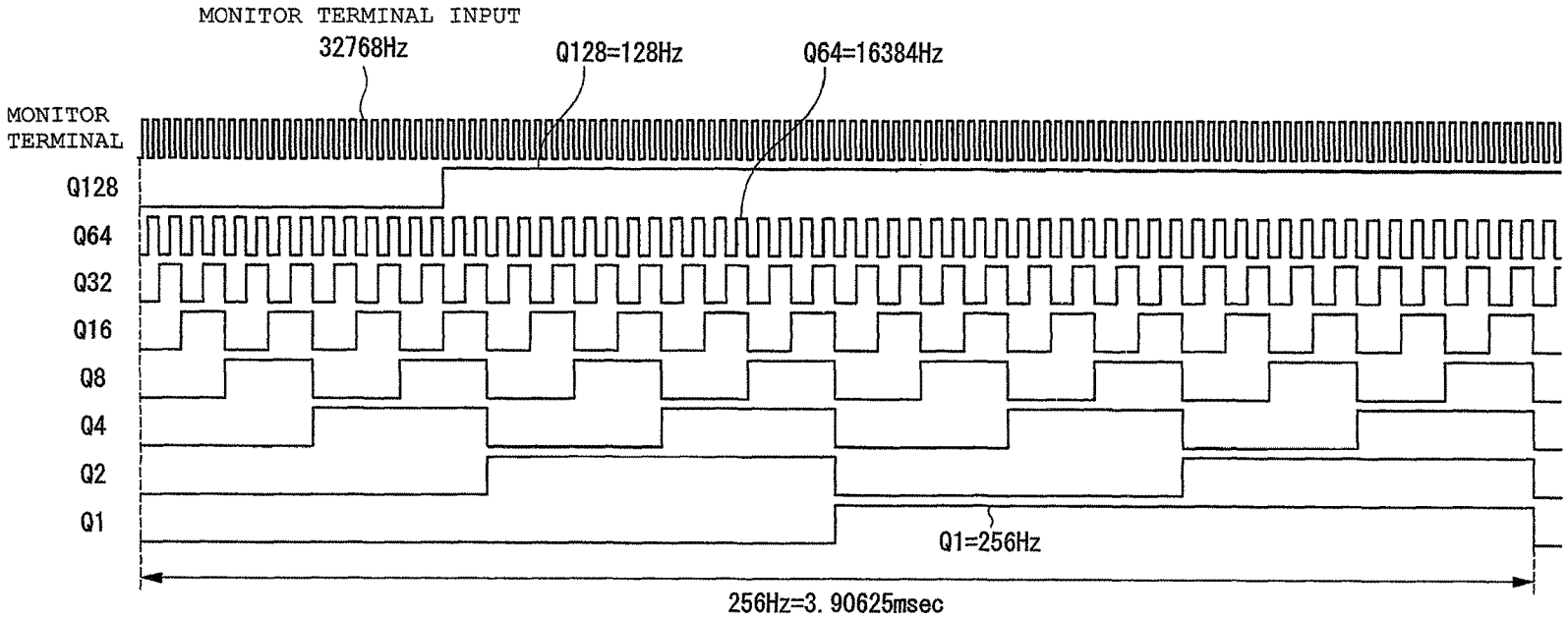
FIG. 5 is a timing chart illustrating an operation of outputting a frequency division signal by dividing a signal of 32768 Hz which is input to the lower stage frequency division circuit.

FIG. 5 is a timing chart illustrating an operation of outputting a frequency division signal by dividing the signal of 32768 Hz which is input to the lower stage frequency division circuit 25. In FIG. 5, Q64 is an output signal of a first stage of multiple frequency dividers, which are connected in series, of a frequency divider group in the lower stage frequency division circuit 25. Hereinafter, Q32, Q16, Q8, Q4, Q2, and Q1 are respectively output signals of a second stage, a third stage, a fourth stage, a fifth stage, a sixth stage, and a seventh stage of the frequency dividers of the frequency divider group.

The signal of 32768 Hz which is input to the monitor terminal is input to the lower stage frequency division circuit 25 through the buffer circuit 23, is divided into Q64=16384 Hz, Q32=8192 Hz, Q16=4096 Hz, Q8=2048 Hz, Q4=1024 Hz, and Q2=512 Hz, and is divided to a signal of Q1=256 Hz (3.90625 msec) which is a frequency division signal.

That is, a signal which is Q1=1 Hz in FIG. 4, becomes 256 Hz in FIG. 5, and one second can be reduced to 3.90625 msec.

Thereafter, the selection control signal which is input to the selection circuit 24 is changed from an L level to an H level, and thereby the input signal (intermediate signal 1) from the monitor terminal is stopped, and a signal (intermediate signal 2) of Q128=128 Hz which is a signal from the upper stage frequency division circuit 21 is input to the lower stage frequency division circuit 25. By doing this, it is possible to reduce inspection time by accelerating the intermediate signal 1 using the lower stage frequency division circuit 25 until timing in which the intermediate signal 2 is input to the lower stage frequency division circuit 25, that is, timing in which a motor drive pulse is output. Hence, it is possible to use the motor drive pulse as a real time pulse (pulse which drives a motor in each second) after timing in which the intermediate signal 2 is input to the lower stage frequency division circuit 25.

Referring to FIG. 1, the switching time count circuit 26 counts a predetermined amount of time after startup of a frequency division circuit, such as, application of power supply, or reset release of a system, and after a predetermined amount of time passes, the intermediate signal which is output from the selection circuit 24 is switched from the intermediate signal 1 (first intermediate signal) to the intermediate signal 2 (second intermediate signal). The switching time count circuit 26 counts a predetermined amount of time, based on an output signal (referred to as Q1 in the present embodiment) of one of the frequency dividers of the frequency divider group in the lower stage frequency division circuit 25.

Figure 6:
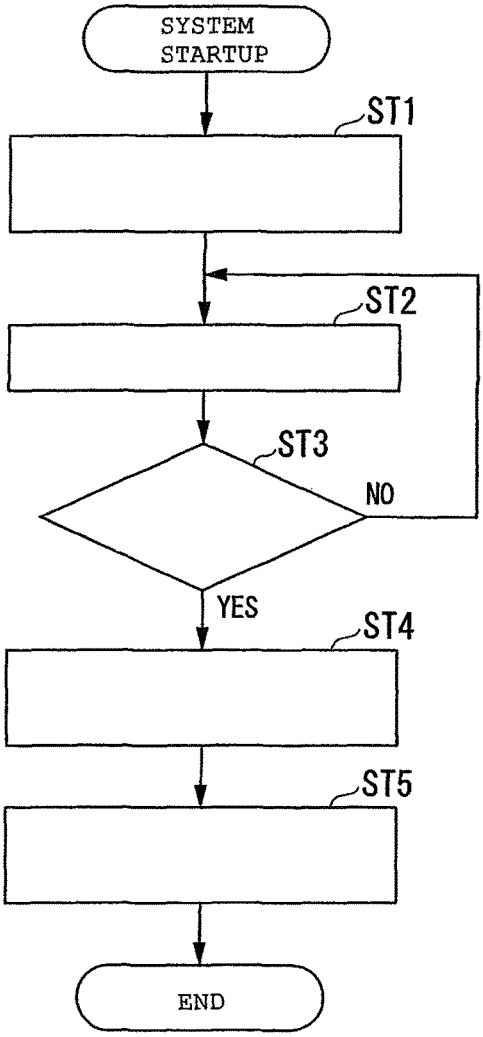
FIG. 6 is a flow chart illustrating a control operation of a switching time count circuit according to the present embodiment.

Here, a control operation of the switching time count circuit 26 will be described with reference to FIG. 6. FIG. 6 is a flow chart illustrating the control operation of the switching time count circuit 26 according to the present embodiment.

In the present embodiment, it is assumed that a selection control signal which is input to the selection circuit 24 is in an L level after startup of a frequency division circuit, such as, application of power supply, or reset release of a system.

In addition, here, a case in which an oscillation source is not connected to a monitor terminal, and an output signal of the upper stage frequency division circuit 21 is output to the monitor terminal, that is, a case in which an input signal of the lower stage frequency division circuit 25 is Q128 will be described.

The oscillation circuit 11 and the frequency division circuit 12 are operated by application of a power supply and reset release of a system.

An intermediate signal which is input to the lower stage frequency division circuit 25 is set as an intermediate signal 1 (step ST1).

The switching time count circuit 26 outputs the selection control signal in an L level to the selection circuit 24.

As a result, the selection circuit 24 selects the intermediate signal 1, and a signal of Q128=128 Hz which is output from the upper stage frequency division circuit 21 is input to the lower stage frequency division circuit 25 through the buffer circuit 22 and the buffer circuit 23.

Subsequently, switching time count processing is performed (step ST2).

The switching time count circuit 26 counts a frequency division output of the lower stage frequency division circuit 25, for example, Q1=1 Hz.

It is determined whether or not the counting reaches switching time (step ST3).

If desired count time (predetermined amount of time) is set to switching time of 10 sec, the switching time count circuit 26 determines whether or not the counting reaches the switching time when the counting is performed up to 10 sec.

If the counting does not reach the switching time, the switching time count circuit 26 returns to step ST2 (step ST3-No). The switching time count circuit 26 continuously outputs the selection control signal in an L level to the selection circuit 24, such that a signal selected by the selection circuit 24 becomes the intermediate signal 1.

Meanwhile, if the counting reaches the switching time, the switching time count circuit 26 proceeds to step ST4 (step ST3—Yes).

An output of the selection circuit is set to the intermediate signal 2 (step ST4).

The switching time count circuit 26 outputs the selection control signal in an H level to the selection circuit 24.

As a result, the selection circuit 24 selects the intermediate signal 2, and a signal of Q128=128 Hz which is output from the upper stage frequency division circuit 21 is input to the lower stage frequency division circuit 25. That is, if an oscillation signal which is accelerated from the monitor terminal is not input during switching time of 10 sec, the intermediate signal is maintained as the signal of Q128=128 Hz, even if the intermediate signal is switched from the intermediate signal 1 to the intermediate signal 2.

A system operation is continued by the intermediate signal 2 (step ST5).

While the oscillation circuit 11 and the frequency division circuit 12 operate, the switching time count circuit 26 continuously outputs the selection control signal in an H level to the selection circuit 24.

While the selection circuit 24 selects the intermediate signal 1, an acceleration input from the monitor terminal can be input to the lower stage frequency division circuit 25 by the above-described operation, but, after the intermediate signal is switched to the intermediate signal 2, the acceleration input from the monitor terminal cannot be input to the lower stage frequency division circuit 25.

Figure 7:
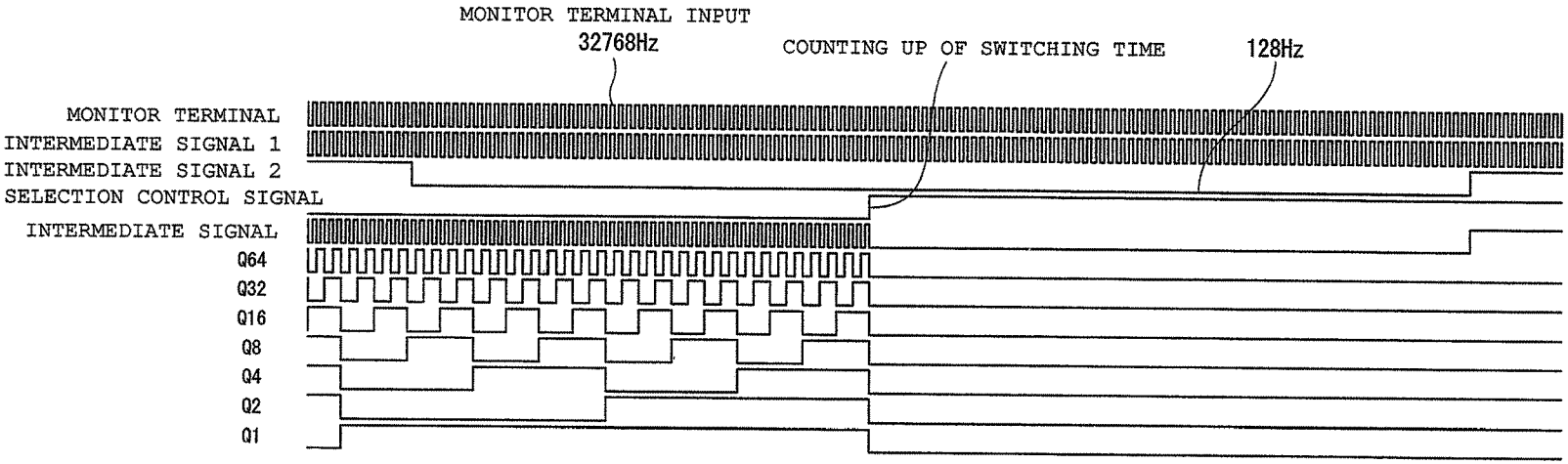
FIG. 7 is a timing chart illustrating a control operation of the switching time count circuit in a case in which an accelerated oscillation signal is input from a monitor terminal during switching time.
Figure 8:
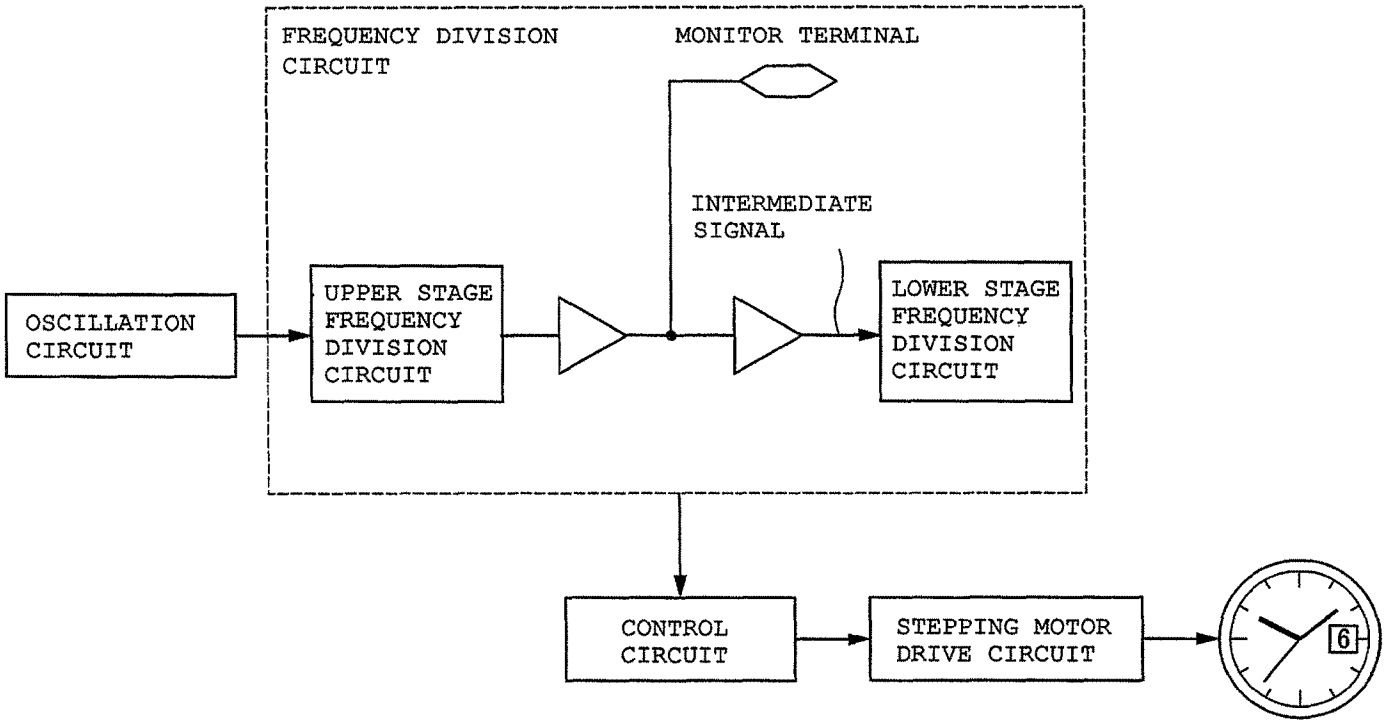
FIG. 8 is a block diagram illustrating a configuration of an analog electronic timepiece of the related art.
Figure 9:
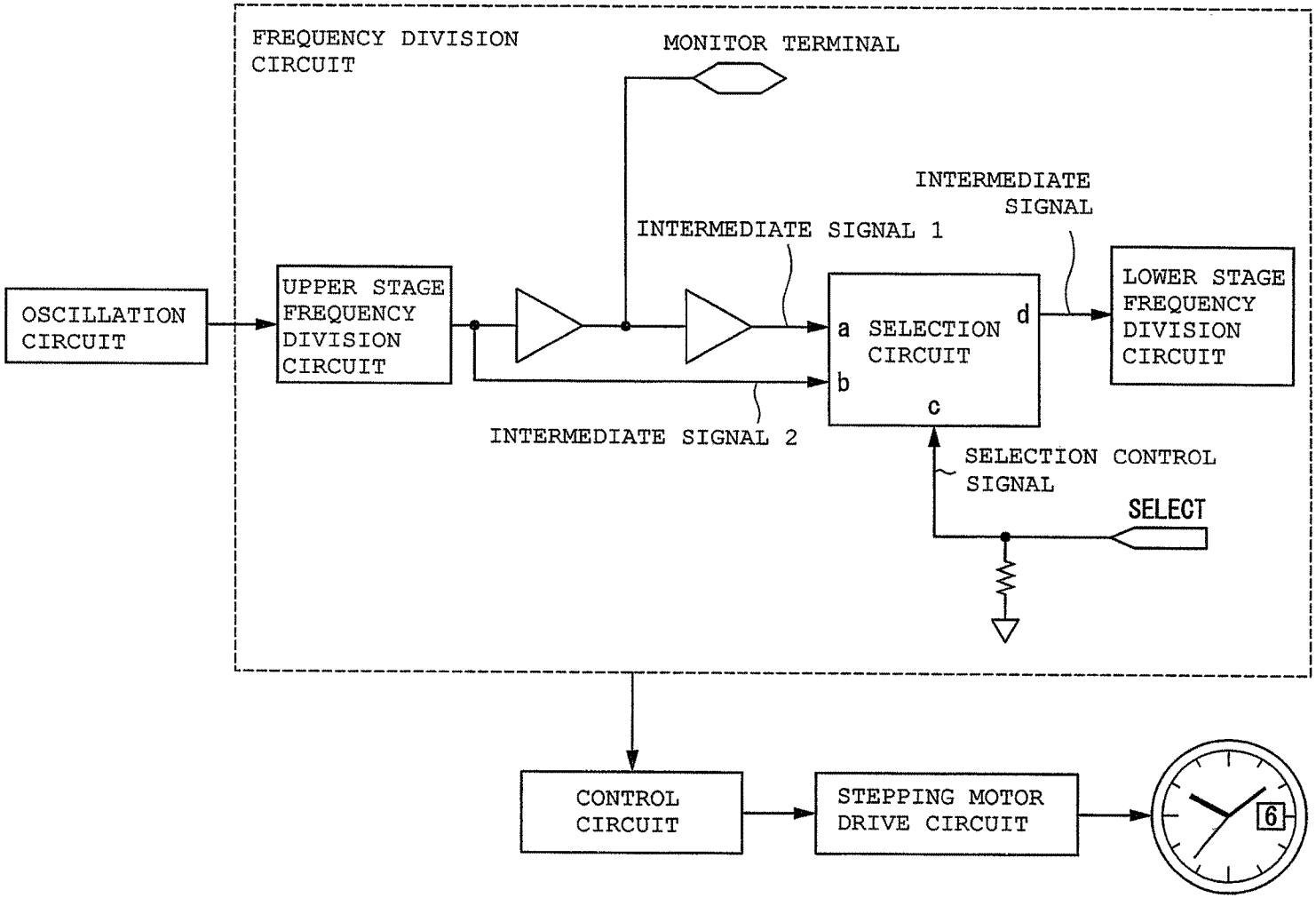
FIG. 9 is a block diagram illustrating a configuration of an analog electronic timepiece of the related art.

In addition, the control operation of the switching time count circuit 26 will be described with reference to FIG. 7. FIG. 7 is a timing chart illustrating the control operation of the switching time count circuit 26 in a case in which an accelerated oscillation signal is input from a monitor terminal during switching time.

FIG. 7 illustrates a case in which an oscillation source with very small output impedance is connected to the monitor terminal, and a signal that is input to the monitor terminal from the oscillation source is set to a signal of 32768 Hz.

The switching time count circuit 26 outputs the selection control signal in an L level to the selection circuit 24.

As a result, the selection circuit 24 selects the intermediate signal 1, and a signal of 32768 Hz which is input from the monitor terminal is input to the lower stage frequency division circuit 25.

The switching time count circuit 26 counts a frequency division output of the lower stage frequency division circuit 25, for example, Q1=256 Hz.

The switching time count circuit 26 determines whether or not counting reaches the switching time when a predetermined amount of time is counted.

If the counting does not reach the switching time, the switching time count circuit 26 continuously outputs the selection control signal in an L level to the selection circuit 24 such that a signal which is selected by the selection circuit 24 becomes the intermediate signal 1.

Meanwhile, if the counting reaches the switching time, the switching time count circuit 26 outputs the selection control signal in an H level to the selection circuit 24.

As a result, the selection circuit 24 selects the intermediate signal 2, and a signal of Q128=128 Hz which is output from the upper stage frequency division circuit 21 is input to the lower stage frequency division circuit 25. That is, even if an oscillation signal which is accelerated from the monitor terminal is input during the switching time, the intermediate signal is switched from the intermediate signal 1 to the intermediate signal 2 thereby becoming the signal of Q128=128 Hz.

While the oscillation circuit 11 and the frequency division circuit 12 operate, the switching time count circuit 26 continuously outputs the selection control signal in an H level to the selection circuit 24.

While the selection circuit 24 selects the intermediate signal 1, an acceleration input from the monitor terminal can be input to the lower stage frequency division circuit 25 by the above-described operation, but, after the intermediate signal is switched to the intermediate signal 2, the acceleration input from the monitor terminal cannot be input to the lower stage frequency division circuit 25.

In FIG. 7, a signal of Q1=256 Hz is output as a frequency division signal until the switching time is counted up (selection control signal is changed from an L level to an H level). However, in fact, in order to test a case in which real time pulse (pulse for driving a motor in each one second) is used as a motor drive pulse, a frequency of an output signal of the oscillation source connected to the monitor terminal is decreased shortly before the switching time is counted up, and thus the frequency division signal becomes a signal close to Q1=1 Hz.

As described above, according to the present invention, the output signal of the upper stage frequency division circuit 21 (first frequency division circuit) is divided into two signals. One signal is output to the outside for testing through the monitor terminal as an output signal, and is set to the intermediate signal 1 (first intermediate signal) which accelerates an operation of the lower stage frequency division circuit 25 (second frequency division circuit) after the intermediate signal, in response to a signal which is input to the monitor terminal from the outside. The other signal is set to the intermediate signal 2 (second intermediate signal), and the selection circuit 24 selects which one of the intermediate signal 1 and the intermediate signal 2 is input to the lower stage frequency division circuit 25 after the intermediate signal. The switching time count circuit 26 counts a predetermined amount of time after startup of the frequency division circuit, and switches the intermediate signal which is output from the selection circuit 24 from the intermediate signal 1 to the intermediate signal 2, after the predetermined amount of time passes. The intermediate signal 2 is not affected by noise such as static electricity from the monitor terminal in the same manner as the intermediate signal 1. Hence, according to the present invention, it is possible to provide a frequency division circuit which can prevent an abnormal operation.

As described above, an embodiment according to the invention is described in detail with reference to the drawings, but a specific configuration thereof is not limited to this, and various layout modifications or the like can be made in the scope without departing from a spirit of the invention.

For example, in the description of the embodiment, the number of stages of the upper stage frequency division circuit 21 is set to eight, and the number of stages of the lower stage frequency division circuit 25 is set to seven, but the number of stages is not limited to this. In addition, the frequency division signal which is output from the frequency division circuit 12 is set as one signal, but may be set as multiple signals.

What is claimed is:

1. A frequency division circuit comprising:

a first frequency division circuit that divides a frequency of a reference signal and outputs a first frequency-divided signal;

a monitor terminal which outputs the first frequency-divided signal for use in testing and to which an external signal can be input;

a selection circuit connected to receive the first frequency-divided signal output from the first frequency division circuit and an external signal inputted to the monitor terminal, the selection circuit being configured to select and output as an intermediate signal either the first frequency-divided signal or the external signal in response to a selection control signal;

a second frequency division circuit that divides a frequency of the intermediate signal and outputs a second frequency-divided signal; and a switching time count circuit configured to start counting time when the second frequency division circuit starts frequency-dividing the intermediate signal and, after elapse of a predetermined amount of time, output a selection control signal to the selection circuit to cause the selection circuit to output the first frequency-divided signal as the intermediate signal.

2. The frequency division circuit according to claim 1; wherein the switching time count circuit is configured to output a selection control signal that causes the selection circuit to output the first frequency-divided signal as the intermediate signal when an external signal is not input to the monitor terminal.

3. The frequency division circuit according to claim 1; wherein the external signal has a frequency higher than the frequency of the first frequency-divided signal.

4. The frequency division circuit according to claim 1; wherein the external signal has a frequency that is an integer number times higher than the frequency of the first frequency-divided signal.

5. The frequency division circuit according to claim 1, wherein the second frequency division circuit includes a frequency divider group in which multiple frequency dividers are connected in series, each dividing a frequency of an input signal in half to output as an output signal, and wherein the switching time count circuit counts the predetermined amount of time, based on an output signal of one of the frequency dividers of the frequency divider group.

6. An analog electronic timepiece comprising:

the frequency division circuit according to claim 1;

a stepping motor which rotationally drives hands of the timepiece; and circuitry which generates drive pulses in synchronism with a frequency division signal output from the frequency division circuit for stepwise rotationally driving the stepping motor.

* * * * *